US009228789B1

(12) United States Patent
Oglesby

(10) Patent No.: US 9,228,789 B1
(45) Date of Patent: Jan. 5, 2016

(54) MUZZLE BRAKE

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 0 days.

(21) Appl. No.: 14/499,993

(22) Filed: Sep. 29, 2014

Related U.S. Application Data

(63) Continuation-in-part of application No. 29/454,732, filed on May 14, 2013, now Pat. No. Des. 716,904, and a continuation-in-part of application No. 29/476,894, filed on Dec. 18, 2013, now Pat. No. Des. 716,408.

(51) Int. Cl.
*F41A 21/36* (2006.01)
*F41A 21/34* (2006.01)

(52) U.S. Cl.
CPC *F41A 21/36* (2013.01); *F41A 21/34* (2013.01)

(58) Field of Classification Search
CPC ..... F41A 21/325; F41A 21/24; F41A 21/36; F41A 21/38
USPC ..... 89/14.3, 14.4; 181/223; 42/1.06, 76.01, 42/77, 107; D22/108
See application file for complete search history.

(56) References Cited

U.S. PATENT DOCUMENTS 3,115,060 A * 12/1963 Ashbrook ..... F41A 21/36 89/14.3
D285,238 S * 8/1986 Cellini ..... F16M 11/041 89/14.3
4,879,942 A * 11/1989 Cave ..... F41A 21/36 89/14.3
7,032,339 B1 * 4/2006 Bounds ..... F41A 21/36 42/1.06
8,087,337 B1 * 1/2012 Cary ..... F41A 21/30 89/14.3
8,418,803 B2 * 4/2013 Findlay ..... F41A 21/30 181/223
2008/0083321 A1 * 4/2008 Dueck ..... F41A 21/36 89/14.3
2010/0224054 A1 * 9/2010 Langner ..... F41A 21/36 89/14.3
2010/0269387 A1 * 10/2010 Drajan ..... F41A 21/36 42/1.06
2011/0226121 A1 * 9/2011 Peterson ..... F41A 21/36 89/14.3
2013/0199071 A1 * 8/2013 Lee ..... F41A 21/325 42/76.01

* cited by examiner

*Primary Examiner* — Samir Abdosh
*Assistant Examiner* — John D Cooper
(74) *Attorney, Agent, or Firm* — Shaddock Law Group, PC

(57) ABSTRACT

A muzzle brake having a body portion; a central borehole aperture extending through said body portion, having a central borehole aperture diameter; a first expansion chamber disposed within the central borehole aperture, proximate said initial end, wherein said first expansion chamber has a diameter greater than the central borehole aperture diameter; first baffle walls defining a first baffle port; second baffle walls defining a second baffle port; third baffle walls defining a third baffle port; a pair of expansion apertures, wherein said pair of expansion apertures are formed at an acute angle to one another; and a pair of baffle apertures, wherein said pair of baffle apertures are formed at an acute angle to one another.

20 Claims, 15 Drawing Sheets

MUZZLE BRAKE

CROSS-REFERENCE TO RELATED APPLICATIONS

This patent application claims the benefit of U.S. patent application Ser. No. 29/454,732, filed May 14, 2013, and U.S. patent application Ser. No. 29/476,894, filed Dec. 18, 2013, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, the applicant owns all trademarks and service marks identified herein.

BACKGROUND OF THE INVENTION

1. Field of the Invention

The present disclosure relates generally to the field of firearms. More specifically, the present invention relates to an enhanced muzzle brake for firearms.

2. Description of Related Art

A muzzle brake is a device that is attached to the terminal end of a muzzle of a firearm that redirects propellant gases to counter recoil and unwanted barrel rise that normally occurs during the normal firing sequence.

During normal operation of a firearm, and particularly a rifle, when a round is fired, gas from the burning propellant forces the bullet through the barrel. As the bullet travels down and out of the barrel, the bullet and the propellant gases act on barrel, along the longitudinal axis, or centerline, of the barrel, to produce a recoil force. Because of the difference between the longitudinal axis of the barrel and the average point of contact between the firearm and the user (the average point where the user resists the recoil force), the muzzle end of the firearm's barrel rotates upward.

Muzzle brakes typically utilize one or more slots, vents, holes, and/or baffles to divert and/or redirect the propellant gases as they leave the barrel. Generally, muzzle brakes divert and/or redirect the propellant gases horizontally (left and right), at some angle that is substantially perpendicular to the longitudinal axis of the barrel.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

The typical muzzle brake geometry and arrangement has various shortcomings. For example, known muzzle brakes have a relatively consistent internal bore diameter and do not allow for sufficient propellant gas volume and high gas pressure at the muzzle end of the firearm. Because of this, known muzzle brakes do not produce an effective amount of recoil reduction.

Additionally, known muzzle brakes also fail to add a sufficient amount of surface area to the terminal end of the firearm barrel.

Thus, the features and elements of the presently disclosed muzzle brakes provide various muzzle brakes features and design elements that overcome the shortcomings of known muzzle brakes and provide improved, enhanced muzzle brakes.

In various exemplary, non-limiting embodiments, the muzzle brake of the present invention includes a body portion extending along a longitudinal axis from an initial end to a terminal end; a central borehole aperture extending through the body portion, along the longitudinal axis of the body portion, having a central borehole aperture diameter; a first expansion chamber disposed within the central borehole aperture, proximate the initial end, wherein the first expansion chamber has a diameter greater than a diameter of the central borehole aperture; first baffle walls defining a first baffle port, wherein the first baffle port comprises an aperture extending along a first baffle port longitudinal axis, wherein the first baffle port longitudinal axis is substantially perpendicular to the longitudinal axis of the central borehole aperture, and wherein the first baffle port is in fluid communication with the central borehole aperture and an exterior of the body portion such that at least some gasses from the central borehole aperture can be directed through the first baffle port to the exterior of the body portion; second baffle walls defining a second baffle port, wherein the second baffle port comprises an aperture extending along a second baffle port longitudinal axis, wherein the second baffle port longitudinal axis is substantially perpendicular to the longitudinal axis of the central borehole aperture, and wherein the second baffle port is in fluid communication with the central borehole aperture and an exterior of the body portion such that at least some gasses from the central borehole aperture can be directed through the second baffle port to the exterior of the body portion; third baffle walls defining a third baffle port, wherein the third baffle port comprises an aperture extending along a third baffle port longitudinal axis, wherein the third baffle port longitudinal axis is substantially perpendicular to the longitudinal axis of the central borehole aperture, and wherein the third baffle port is in fluid communication with the central borehole aperture and an exterior of the body portion such that at least some gasses from the central borehole aperture can be directed through the third baffle port to the exterior of the body portion; a pair of expansion apertures, wherein each of the pair of expansion apertures is in fluid communication with the central borehole aperture in the first expansion chamber and an exterior of the body portion such that at least some gasses from the first expansion chamber can be directed through the pair of expansion apertures to the exterior of the body portion, and wherein the pair of expansion apertures are formed at an acute angle to one another; and a pair of baffle apertures, wherein each of the pair of baffle apertures is in fluid communication with the central borehole aperture within the third baffle port and an exterior of the body portion such that at least some gasses from the third baffle port can be directed through the pair of baffle apertures to the exterior of the body portion, and wherein the pair of baffle apertures are formed at an acute angle to one another.

In various exemplary, nonlimiting embodiments, the muzzle brake also includes a second expansion chamber disposed between the first expansion chamber and the first baffle port, along the central borehole aperture, and wherein a diameter of the second expansion chamber is greater than the central borehole aperture diameter.

In various exemplary, nonlimiting embodiments, the muzzle brake further comprises a third expansion chamber disposed between the first baffle port and the second baffle port, along the central borehole aperture, and wherein a diameter of the third expansion chamber is equal to the diameter of the second expansion chamber.

In certain exemplary, nonlimiting embodiments, the muzzle brake further includes a fourth expansion chamber disposed between the second baffle port and the third baffle port, along the central borehole aperture, and wherein a diameter of the forth expansion chamber is less than the diameter of the second expansion chamber and greater than the central borehole aperture diameter.

Optionally, at least a portion of the first baffle wall, the second baffle wall, and/or the third baffle wall extends beyond an outer diameter of the body portion to create an extending fin that further increases the surface area of the baffle wall(s).

The use of the specific baffle ports and expansion chambers of the present invention helps to slow escaping gases and provide a superior linear compensator or muzzle brake. The further addition of expansion apertures and baffle apertures provides a long, multi-chambered recoil compensator or muzzle break.

Accordingly, the presently disclosed invention provides a muzzle brake with improved recoil reduction.

The presently disclosed invention separately provides a muzzle brake that provides improved reduction in muzzle rise.

The presently disclosed invention separately provides a muzzle brake that has varied internal bore diameters to allow for sufficient propellant gas volume and high gas pressure at the muzzle end of the firearm.

The presently disclosed invention separately provides a muzzle brake that provides an effective amount of surface area to the terminal end of the firearm barrel.

The presently disclosed invention separately provides a muzzle brake that can be retrofitted to an existing firearm.

The presently disclosed invention separately provides a muzzle brake that can be easily installed by a user.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein.

Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed embodiments of the present invention are disclosed herein. However, it is to be understood that the disclosed embodiments are merely exemplary of the invention that may be embodied in various and alternative forms. The figures are not necessarily to scale and some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
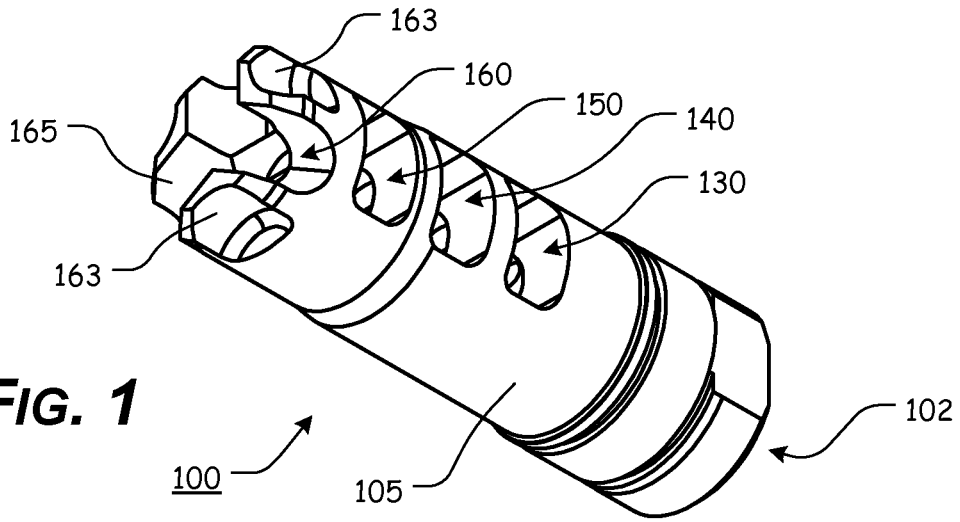
FIG. 1 shows a lower front perspective view of a first exemplary embodiment of a muzzle device, according to this invention.
Figure 2:
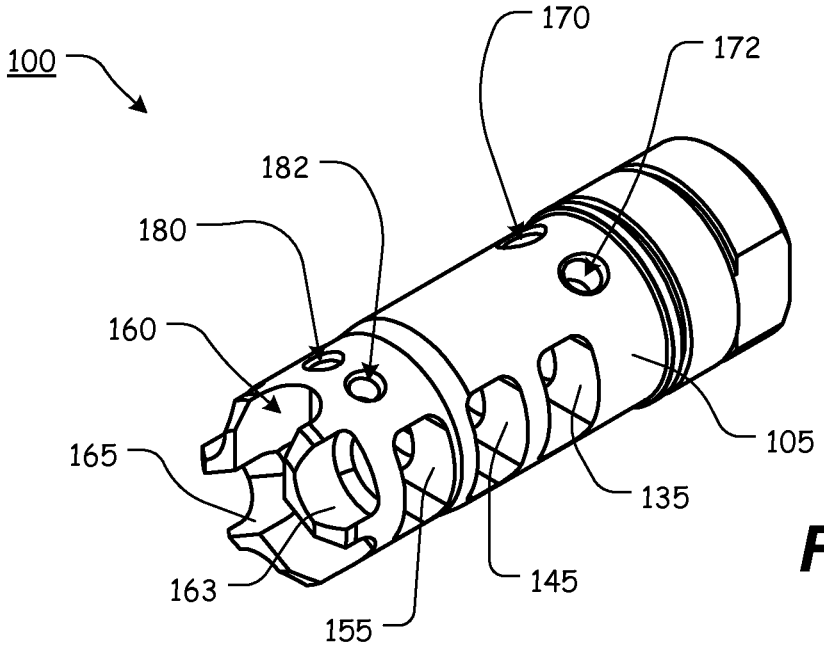
FIG. 2 shows an upper front perspective view of a first exemplary embodiment of a muzzle device, according to this invention.
Figure 3:
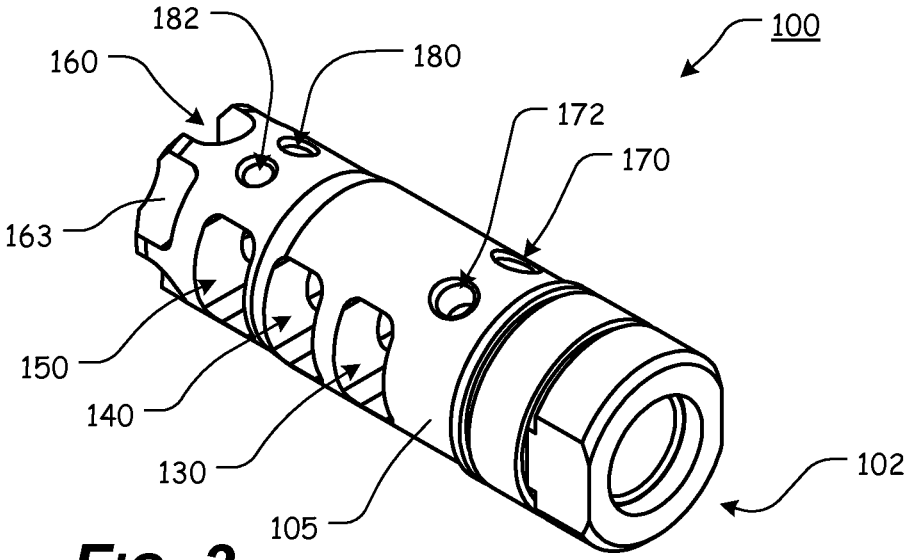
FIG. 3 shows an upper rear perspective view of a first exemplary embodiment of a muzzle device, according to this invention.
Figure 4:
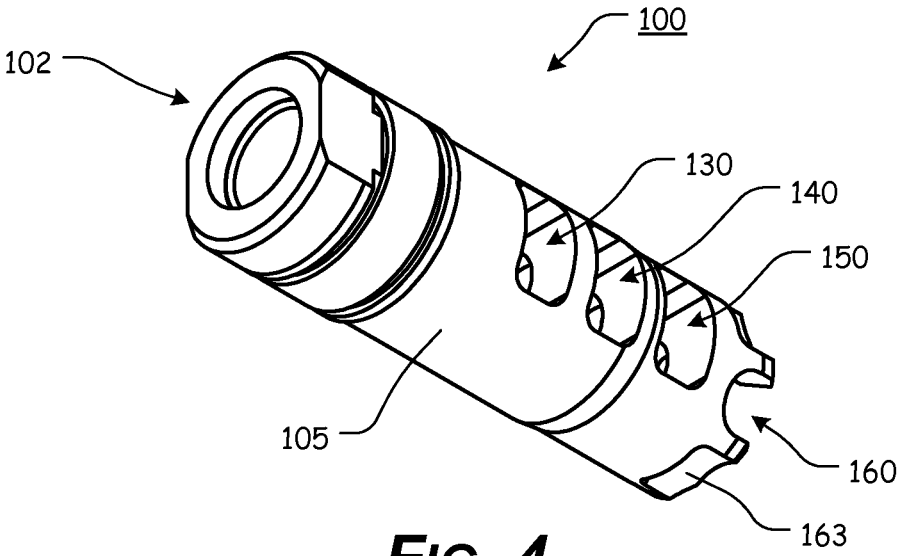
FIG. 4 shows a lower rear perspective view of a first exemplary embodiment of a muzzle device, according to this invention.
Figure 5:
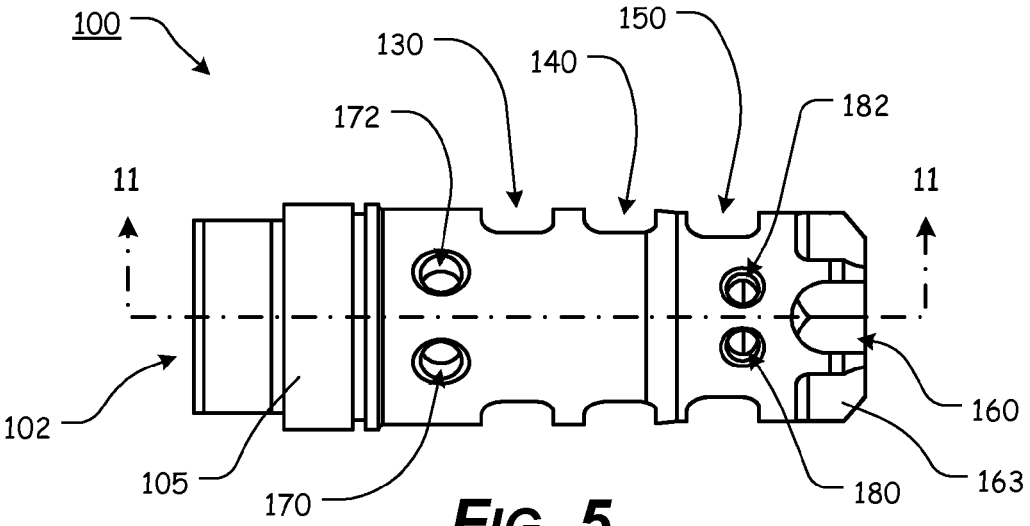
FIG. 5 shows a top plan view of a first exemplary embodiment of a muzzle device, according to this invention.
Figure 6:
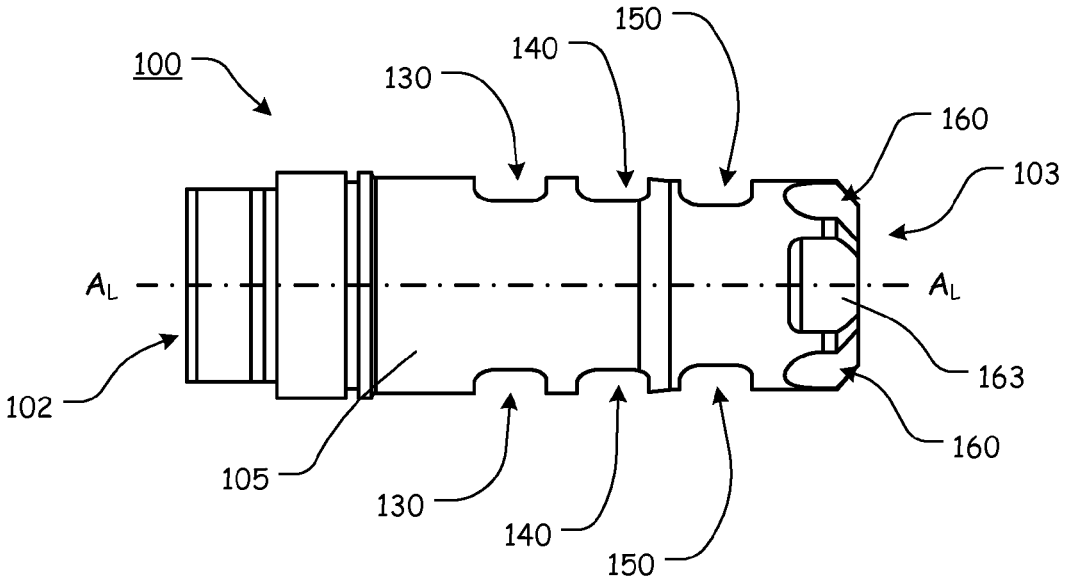
FIG. 6 shows a bottom plan view of a first exemplary embodiment of a muzzle device, according to this invention.
Figure 7:
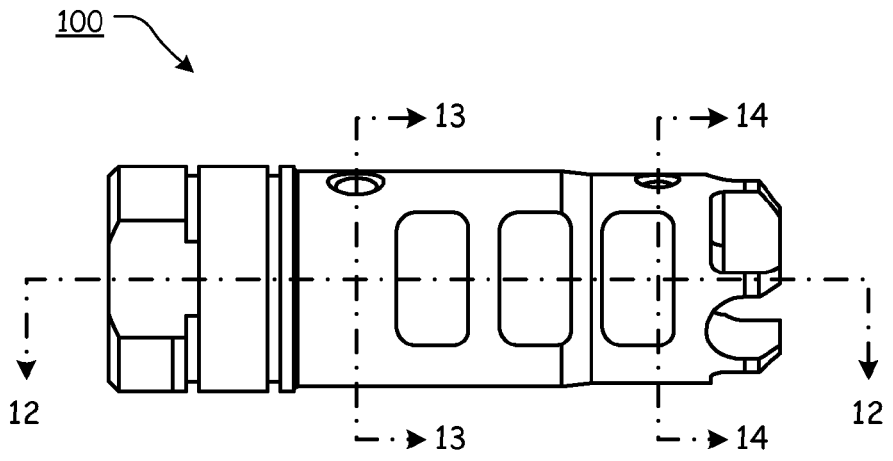
FIG. 7 shows a right side view of a first exemplary embodiment of a muzzle device, according to this invention.
Figure 8:
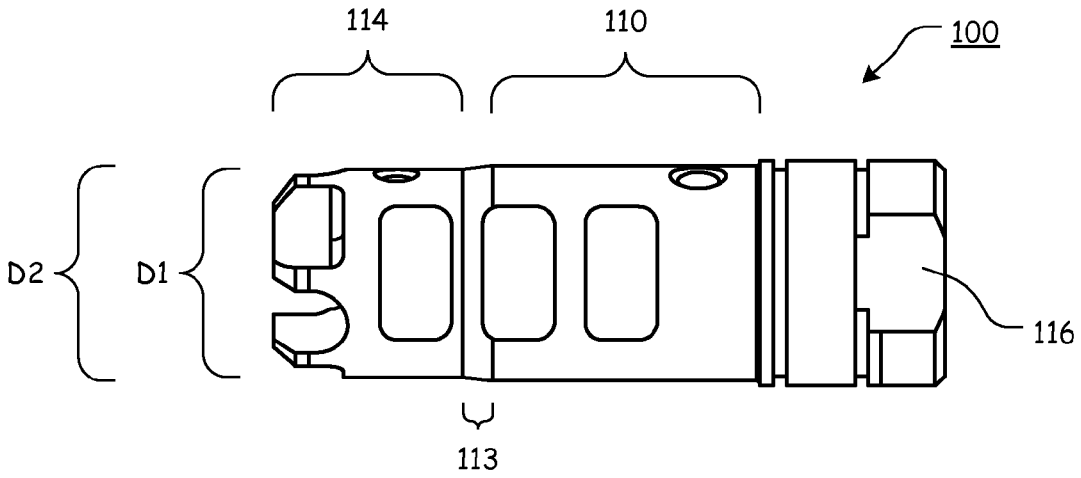
FIG. 8 shows a left side view of a first exemplary embodiment of a muzzle device, according to this invention.
Figure 9:
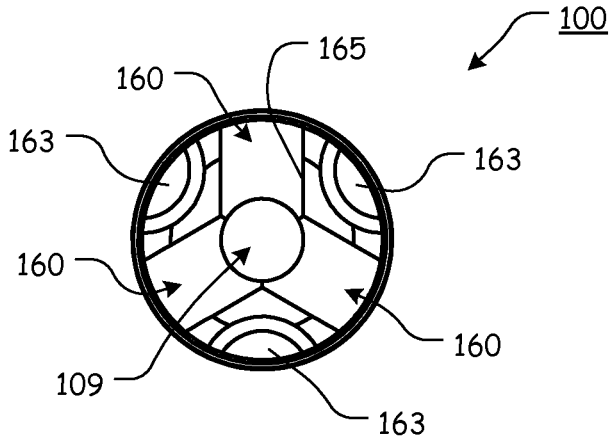
FIG. 9 shows a front view of a first exemplary embodiment of a muzzle device, according to this invention.
Figure 10:
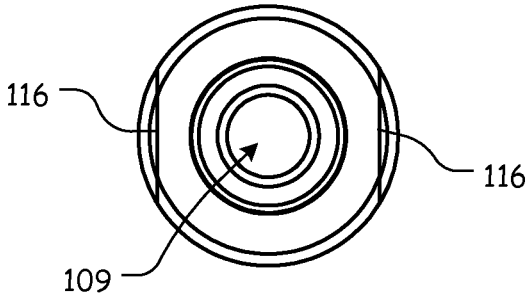
FIG. 10 shows a rear view of a first exemplary embodiment of a muzzle device, according to this invention.

For simplicity and clarification, the design factors and operating principles of the muzzle brake according to this invention are explained with reference to various exemplary embodiments of a muzzle brake according to this invention. The basic explanation of the design factors and operating principles of the muzzle brake is applicable for the understanding, design, and operation of the muzzle brake of this invention. It should be appreciated that the muzzle brake can be adapted to many applications where a muzzle brake can be used.

It should also be appreciated that the terms "firearm" and "muzzle brake" are used for basic explanation and understanding of the operation of the systems, methods, and apparatuses of this invention. Therefore, the terms "firearm" and "muzzle brake" are not to be construed as limiting the systems, methods, and apparatuses of this invention.

For simplicity and clarification, the muzzle brakes of this invention will be described as being used in connection with a rifle. However, it should be appreciated that these are merely exemplary embodiments of the muzzle brakes and are not to be construed as limiting this invention. Thus, the muzzle brakes of this invention may be utilized in connection with any rifle, pistol, artillery piece, firearm, or other device.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing FIGS., FIGS. 1-14 illustrate certain elements and/or aspects of a first exemplary embodiment of a muzzle brake 100, according to this invention. In certain illustrative, non-limiting embodiments of this invention, as illustrated in FIGS. 1-14, the muzzle brake 100 comprises at least some of a muzzle brake body portion 105, a first expansion chamber 121, a first baffle port 130, a second baffle port 140, a third baffle port 150, expansion apertures 170 and 172, and baffle apertures 180 and 182.

The body portion 105 comprises an elongate portion of substantially cylindrical material that extends along a longitudinal axis $A_L$ from an initial end 102 to a terminal end 103. In certain exemplary embodiments, various components of the muzzle brake 100, including the body portion 105, are formed of steel. Alternate materials of construction of the various components of the body portion 105 may include one or more of the following: stainless steel, aluminum, titanium, and/or other metals, as well as various alloys, combinations, and/or composites thereof. Thus, it should be understood that the material or materials used to form the muzzle brake 100 is a design choice based on the desired appearance, strength, and functionality of the muzzle brake 100.

In various exemplary, nonlimiting embodiments, an outer diameter of the body portion 105 is substantially consistent from an area proximate the first expansion chamber 121 to the terminal end 103. Alternatively, the body portion 105 comprises a first portion 110 (proximate the initial end 102) having a first outer diameter D1 and a second portion 114 (proximate the terminal end 103) having a second outer diameter D2. In these embodiments, the first outer diameter D1 is greater than the second outer diameter D2 and a transition portion 113 is disposed between the first portion 110 and the second portion 114 to provide a relatively smooth transition between the first outer diameter D1 and the second outer diameter D2.

To aid in the installation of the muzzle brake 100, parallel flats 116 may be provided on either side of the body portion 105, proximate the initial end 102. The flats 116 provide parallel surfaces for a wrench or other installation device to grip the muzzle brake 100.

A central borehole aperture 109 extends through the body portion 105, along the longitudinal axis $A_L$ of the body portion 105. The central borehole aperture 109 has a central borehole aperture diameter $D_{CBA}$. Typically, the central borehole aperture diameter $D_{cBA}$ is sufficient to allow the caliber of round with which the muzzle brake 100 is to be utilized to safely pass through the central borehole aperture 109. Thus, it should be appreciated that the diameter $D_{cBA}$ of the central borehole aperture 109 is a design choice based upon the caliber of weapon or other device with which the muzzle brake 100 is to be utilized.

An internally threaded attachment portion 120 extends along the central borehole aperture 109 from the initial end 102 to the first expansion chamber 121. The internally threaded attachment portion 120 is adapted to receive at least a portion of a barrel and allow the muzzle brake 100 to be threadedly attached to the barrel. In various exemplary embodiments, the internally threaded attachment portion 120 has a thread size of ½-24, a common thread size for threaded muzzle devices utilized with 0.223 or 5.56 rifle barrels. However, it should be appreciated that the thread size of the internally threaded attachment portion 120 may be adapted to receive a portion of a barrel having any desired thread size. Thus, the thread size and/or pitch of the internally threaded attachment portion 120 is a design choice based upon the threaded barrel size of the weapon or other device with which the muzzle brake 100 is to be used.

In various exemplary embodiments, the internally threaded attachment portion 120 is initiated by a recessed portion 118. If included, the recessed portion 118 allows a crush or other washer to be easily fitted to the initial end 102 and/or a portion of the recessed portion 118. The recessed portion 118, may also allow for improved ease of threading the muzzle brake 100 to a barrel.

As illustrated, a first expansion chamber 121 is disposed within the central borehole aperture 109, proximate the initial end 102. The first expansion chamber 121 has a diameter $D_{FEC}$ greater than the central borehole aperture diameter $D_{CBA}$ and is positioned so that gases immediately exiting the muzzle of the attached barrel first enter into the first expansion chamber 121. Because of the increase the diameter of the first expansion chamber 121, as gasses enter the first expansion chamber 121, the gasses expand to fill the first expansion chamber 121, slowing the flow of gases through the central borehole aperture 109.

In order for muzzle brakes to operate efficiently, a sufficient volume of propellant gas and high gas pressure is needed at the muzzle of the barrel. By providing the first expansion chamber 121 (and optionally additional expansion chambers, as described herein) the overall volume of the area within the muzzle brake within which the propellant gases flow provides increased recoil reduction.

A first baffle port 130 is defined by first baffle walls 135. The first baffle port 130 comprises an aperture extending along a longitudinal axis $A_{LBP1}$. Typically, the longitudinal axis $A_{LBP1}$ is substantially perpendicular to the longitudinal axis $A_L$ of the central borehole aperture 109. The first baffle port 130 is in fluid communication with the central borehole aperture 109 and an exterior of the body portion 105 such that at least some gasses from the central borehole aperture 109 can be directed through the first baffle port 130 to the exterior of the body portion 105.

Since the longitudinal axis $A_{LBP1}$ is substantially perpendicular to the longitudinal axis $A_L$ of the central borehole aperture 109, the portion of propellant gases that are directed through the first baffle port 130 are directed generally perpendicular to the longitudinal axis $A_L$ of the central borehole aperture 109. This generally directs the propellant gases to the left and right of the muzzle brake 100.

A second baffle port 140 is defined by second baffle walls 145. The second baffle port 140 comprises an aperture extending along a longitudinal axis $A_{LBP2}$. As with the first baffle port 130, the longitudinal axis $A_{LBP2}$ is substantially perpendicular to the longitudinal axis $A_L$ of the central borehole aperture 109. The second baffle port 140 is in fluid communication with the central borehole aperture 109 and an exterior of the body portion 105 such that at least some of the propellant gasses from the central borehole aperture 109 can be directed through the second baffle port 140 to the exterior of the body portion 105.

Since the longitudinal axis $A_{LBP2}$ is substantially perpendicular to the longitudinal axis $A_L$ of the central borehole aperture 109, the portion of propellant gases that are directed through the second baffle port 130 are directed generally perpendicular to the longitudinal axis $A_L$ of the central borehole aperture 109. This generally directs the propellant gases to the left and right of the muzzle brake 100.

A third baffle port 150 is defined by third baffle walls 155. The third baffle port 150 comprises an aperture extending along a longitudinal axis $A_{LBP3}$. As with the first baffle port 130 and the second baffle port 140, the longitudinal axis $A_{LBP3}$ is substantially perpendicular to the longitudinal axis $A_L$ of the central borehole aperture 109. The third baffle port 150 is in fluid communication with the central borehole aperture 109 and an exterior of the body portion 105 such that at least some of the propellant gasses from the central borehole aperture 109 can be directed through the third baffle port 150 to the exterior of the body portion 105.

Since the longitudinal axis $A_{LBP3}$ is substantially perpendicular to the longitudinal axis $A_L$ of the central borehole aperture 109, the portion of propellant gases that are directed through the third baffle port 150 are directed generally perpendicular to the longitudinal axis $A_L$ of the central borehole aperture 109. This generally directs the propellant gases to the left and right of the muzzle brake 100.

In various exemplary embodiments, the overall size of the first baffle port 130, the second baffle port 140, and a third baffle port 150 are substantially similar. In certain alternative embodiments, the overall size of the first baffle port 130 is larger than the overall size of the second baffle port 140, and the overall size of the second baffle port 140 is larger than the overall size of the third baffle port 150. In these exemplary embodiments, the size of each baffle port is successively reduced as the baffle ports appear from the initial end 102 to the terminal end 103. In this manner, a greater amount of propellant gases can be directed out of the muzzle brake 100 as the gasses travel from the initial end 102 to the terminal end 103.

Figure 11:
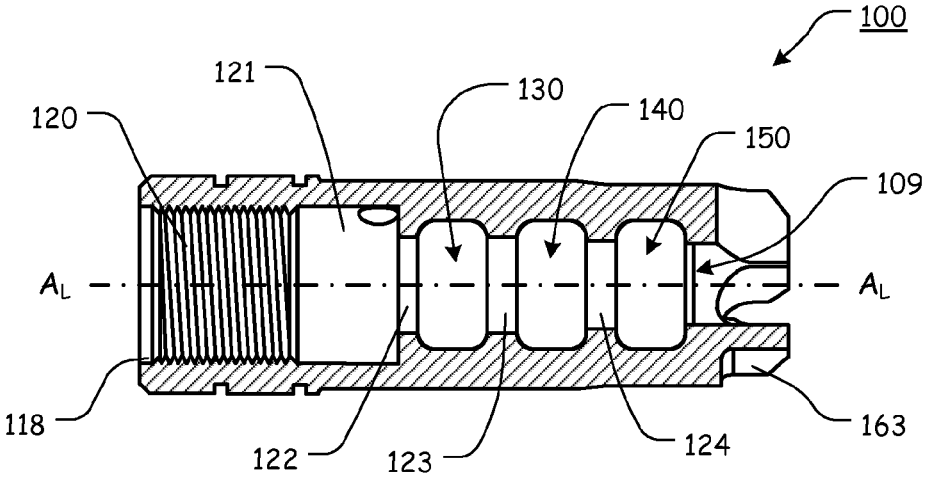
FIG. 11 shows a side cross-sectional view taken along line 11-11 of the gas block of FIG. 5, illustrating the first exemplary embodiment of the muzzle device according to this invention in greater detail.
Figure 12:
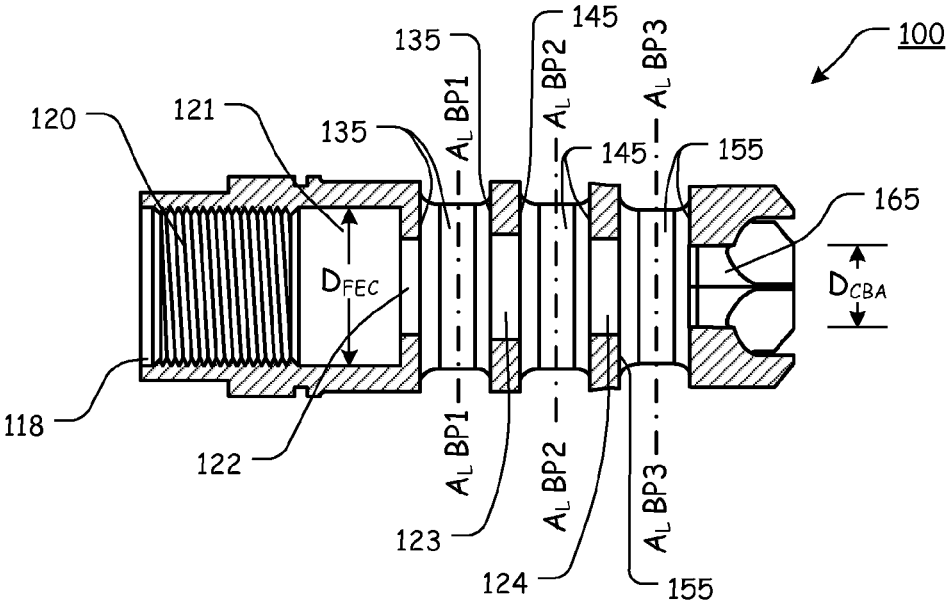
FIG. 12 shows a top cross-sectional view taken along line 12-12 of the gas block of FIG. 7, illustrating the first exemplary embodiment of the muzzle device according to this invention in greater detail.

In various exemplary, nonlimiting embodiments, as illustrated most clearly in FIGS. 11-12, the muzzle brake 100 further comprises a second expansion chamber 122 disposed between the first expansion chamber 121 and the first baffle port 130. The second expansion chamber 122 is disposed along the central borehole aperture 109. A diameter of the second expansion chamber 122 is less than the diameter $D_{FEC}$ of the first expansion chamber 121, but greater than the central borehole aperture diameter $D_{CBA}$. In this manner, the propellant gases are able to make a smoother transition as they exit the first expansion chamber 121 and move towards the first baffle port 130.

The muzzle brake 100 further comprises a third expansion chamber 123 disposed between the first baffle port 130 and the second baffle port 140. The third expansion chamber 123 is disposed along the central borehole aperture 109. In various exemplary embodiments, the diameter of the third expansion chamber 123 is equal to the diameter of the second expansion chamber 122. Alternatively, the diameter of the third expansion chamber 123 may be less than the diameter of the second expansion chamber 122, but still greater than the diameter $D_{CBA}$ of the central borehole aperture 109.

As illustrated, the muzzle brake 100 further comprises a fourth expansion chamber 124 disposed between the second baffle port 140 and the third baffle port 150. As with the second expansion chamber 122 and the third expansion chamber 123, the fourth expansion chamber 124 is disposed along the central borehole aperture 109. The diameter of the fourth expansion chamber 124 is less than the diameter of the second expansion chamber 122 and greater than the diameter $D_{CBA}$ of the central borehole aperture 109.

Thus, in certain exemplary embodiments, the diameter of the second expansion chamber 122 provides a step down from the diameter $D_{FEC}$ of the first expansion chamber 121, the diameter of the third expansion chamber 123 provides either a consistent diameter or a step down from the diameter of the second expansion chamber 122, the diameter of the fourth expansion chamber 124 provides a step down from the diameter of the third expansion chamber 123, and the diameter of the central borehole aperture 109 provides yet another step down from the diameter of the fourth expansion chamber 124.

Thus, as the propellant gases move through the muzzle brake 100, a greater amount of propellant gas is directed from the first baffle port 130 than a third baffle port 150.

The pair of expansion ports or apertures 170 and 172 are optionally created within the first expansion chamber 121. The expansion apertures 170 and 172 are created such that each expansion aperture 170 and 172 is in fluid communication with the central borehole aperture 109, in the first expansion chamber 121, and an exterior of the body portion 105. In this manner, at least some gasses from the first expansion chamber 121 can be directed through the pair of expansion apertures 170 and 172 to the exterior of the body portion 105.

Figure 13:
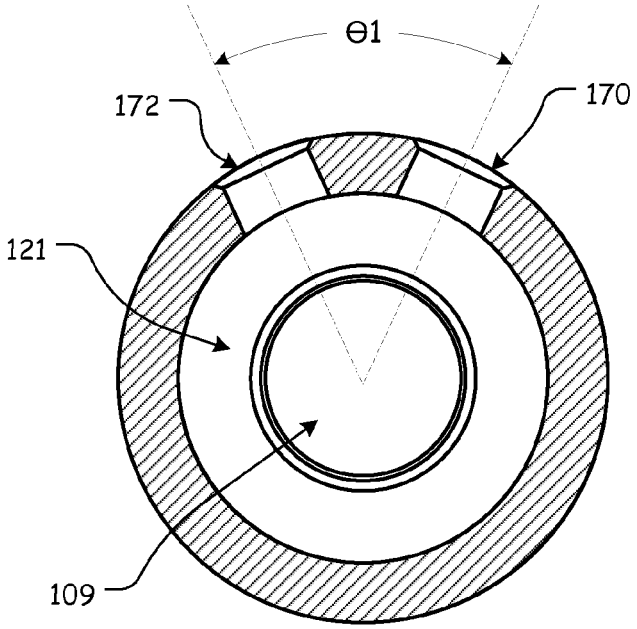
FIG. 13 shows a first rear cross-sectional view taken along line 13-13 of the gas block of FIG. 7, illustrating the first exemplary embodiment of the muzzle device according to this invention in greater detail.

In various exemplary embodiments, as illustrated most clearly in FIG. 13, the expansion apertures 170 and 172 are formed at an angle 1 to one another. In certain exemplary embodiments, the expansion apertures 170 and 172 are formed at an acute angle to one another, such that the expansion apertures 170 and 172 to form a "V". In this manner, the expansion apertures 170 and 172 divert a portion of the propellant gases in directions that reduce the tendency of the firearm to rise during recoil. Muzzle rise is reduced because the propellant gases that are directed upward, through the expansion apertures 170 and 172, cause a reciprocal downward force on the muzzle brake 100.

Additionally, by forming the expansion apertures 170 and 172 in a "V", the propellant gases that are directed through the expansion apertures 170 and 172 are directed away from the aligned sites of the firearm and out of the site picture of the user or operator. In this manner, any debris expelled with the propellant gases is kept out of the user's line of sight.

The pair of expansion ports or apertures 180 and 182 are optionally created within the third baffle port 150. The expansion apertures 180 and 182 are created such that each expansion aperture 180 and 182 is in fluid communication with the central borehole aperture 109, within the third baffle port 150, and an exterior of the body portion 105. In this manner, at least some gasses from the third baffle port 150 can be directed through the pair of expansion apertures 180 and 182 to the exterior of the body portion 105.

Figure 14:
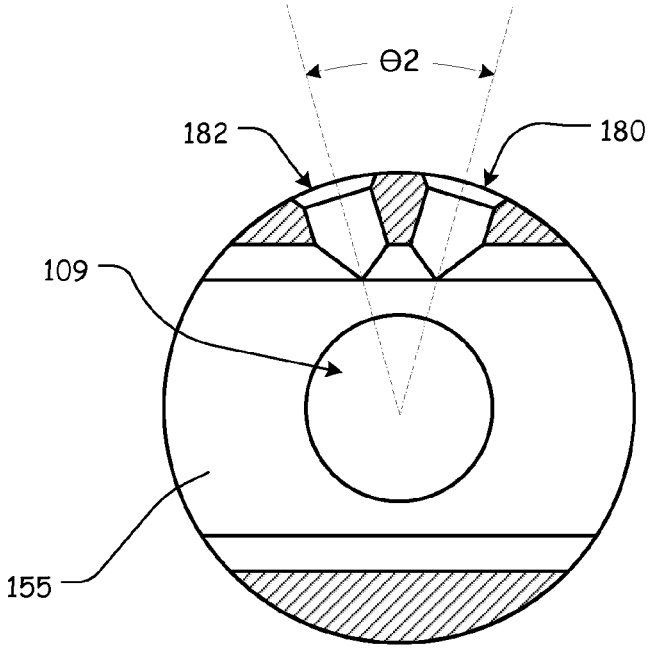
FIG. 14 shows a second rear cross-sectional view taken along line 14-14 of the gas block of FIG. 7, illustrating the first exemplary embodiment of the muzzle device according to this invention in greater detail.
Figure 15:
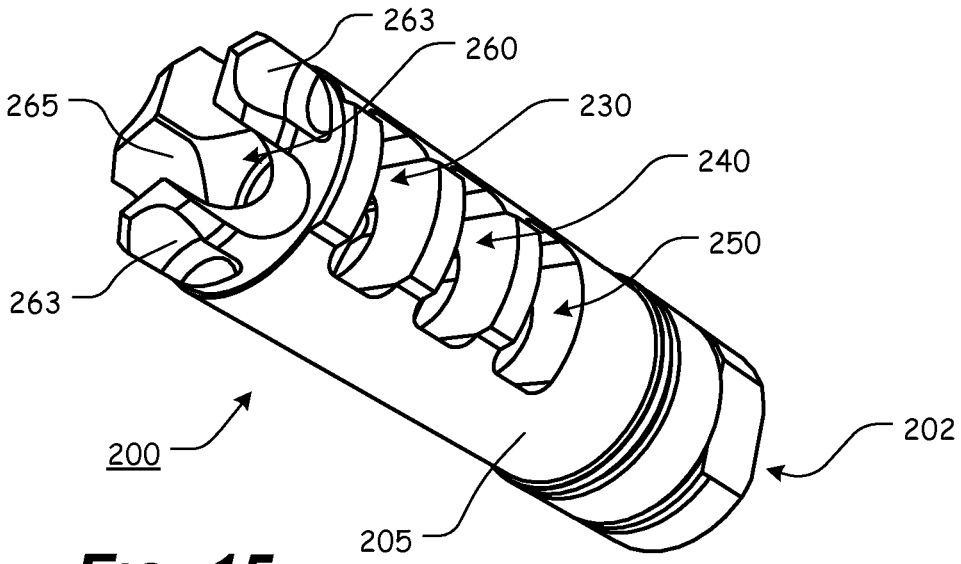
FIG. 15 shows a lower front perspective view of a second exemplary embodiment of a muzzle device, according to this invention.
Figure 16:
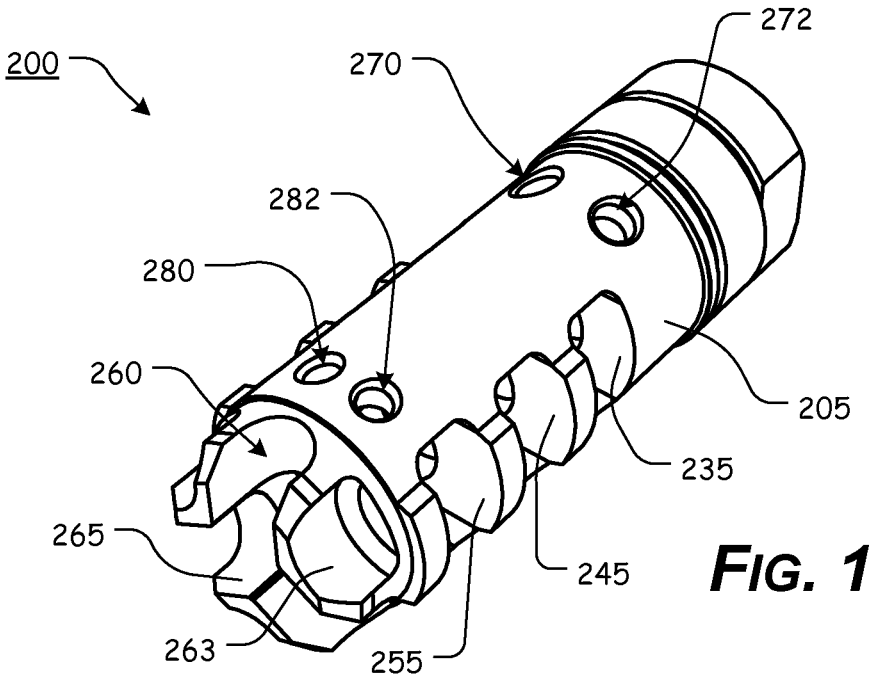
FIG. 16 shows an upper front perspective view of a second exemplary embodiment of a muzzle device, according to this invention.
Figure 17:
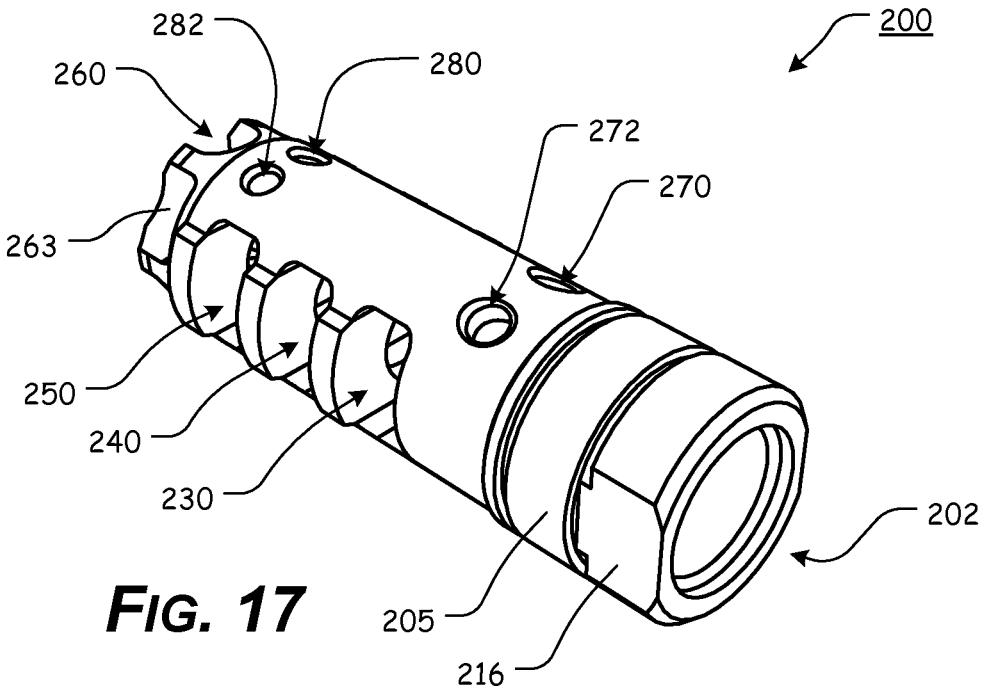
FIG. 17 shows an upper rear perspective view of a second exemplary embodiment of a muzzle device, according to this invention.
Figure 18:
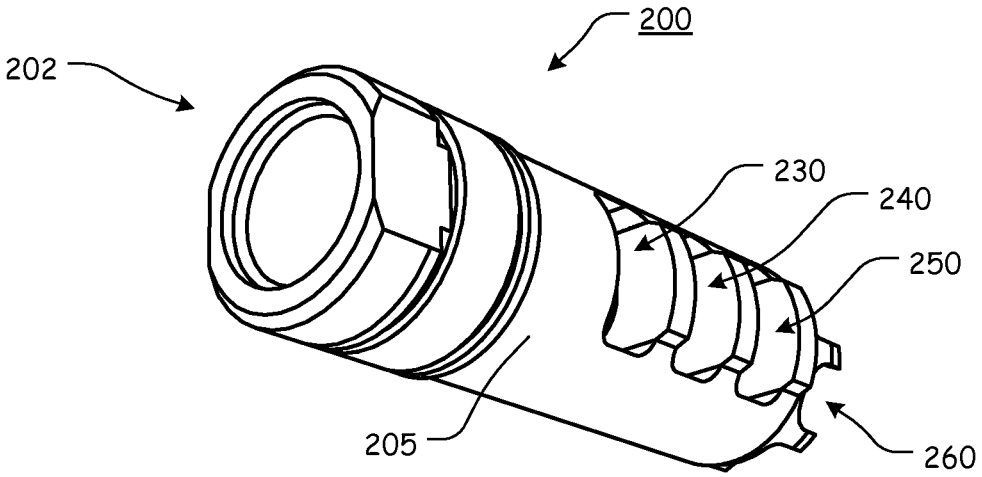
FIG. 18 shows a lower rear perspective view of a second exemplary embodiment of a muzzle device, according to this invention.
Figure 19:
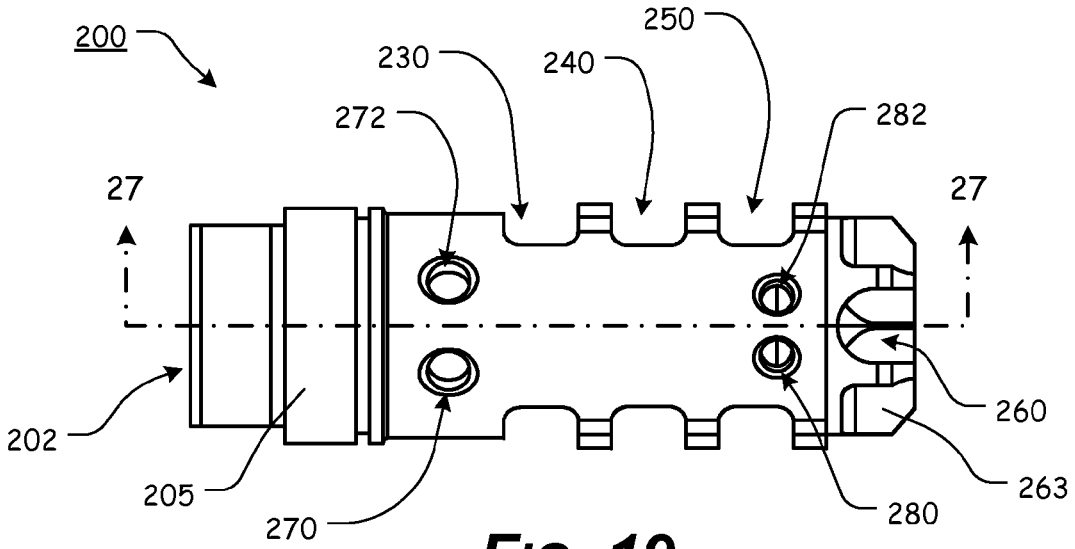
FIG. 19 shows a top plan view of a second exemplary embodiment of a muzzle device, according to this invention.
Figure 20:
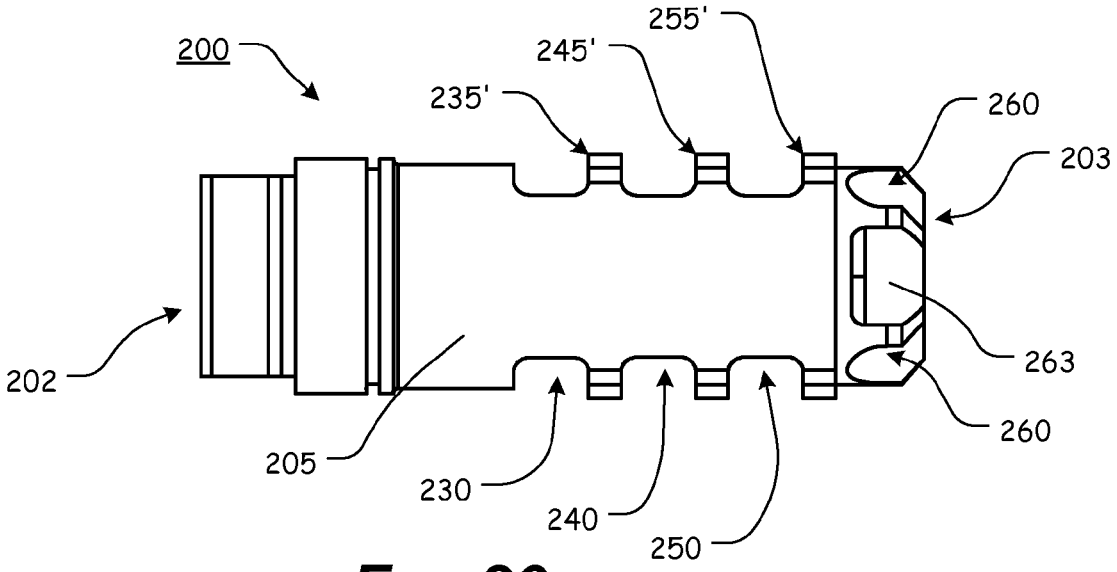
FIG. 20 shows a bottom plan view of a second exemplary embodiment of a muzzle device, according to this invention.
Figure 21:
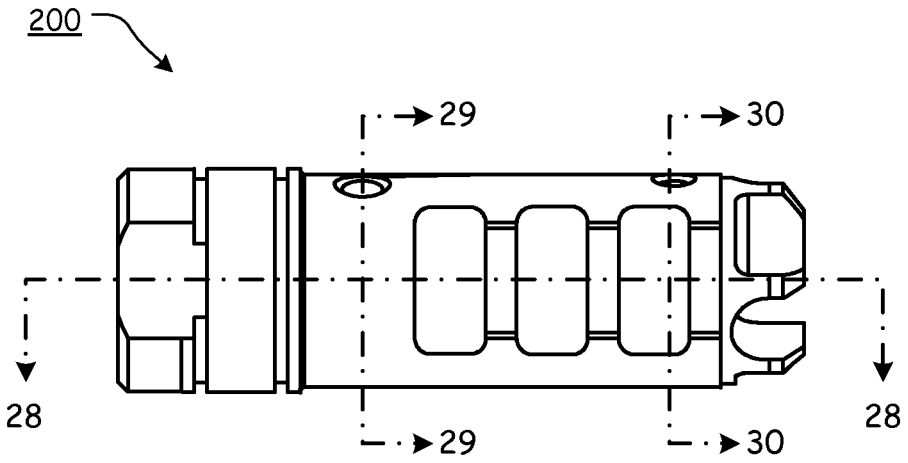
FIG. 21 shows a right side view of a second exemplary embodiment of a muzzle device, according to this invention.
Figure 22:
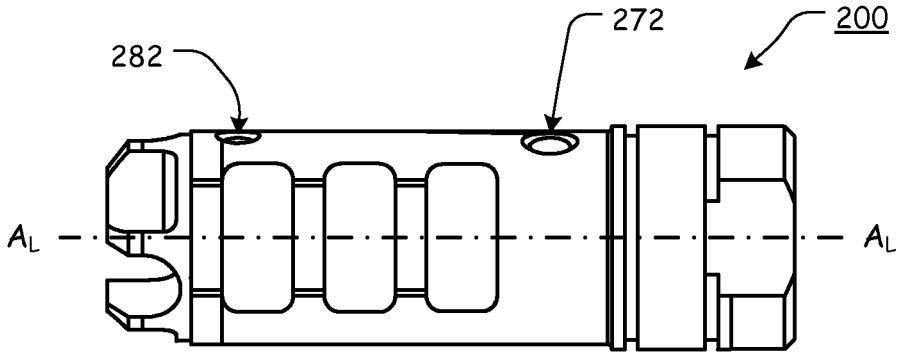
FIG. 22 shows a left side view of a second exemplary embodiment of a muzzle device, according to this invention.
Figure 23:
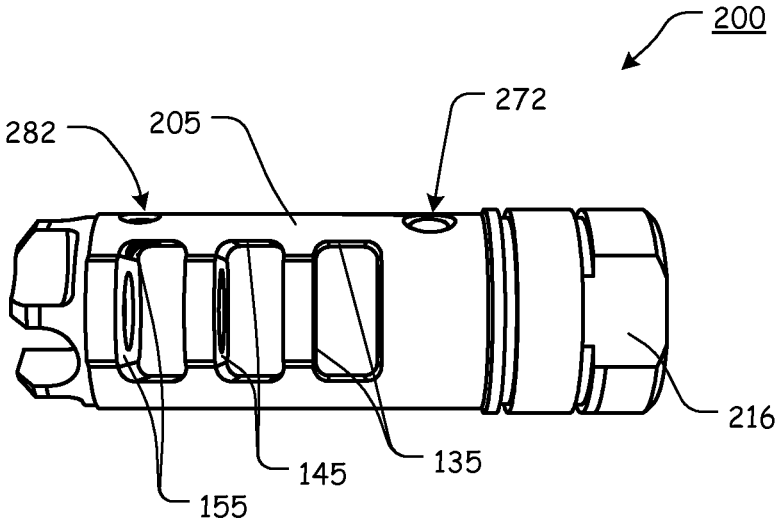
FIG. 23 shows a right side perspective view of a second exemplary embodiment of a muzzle device, according to this invention.
Figure 24:
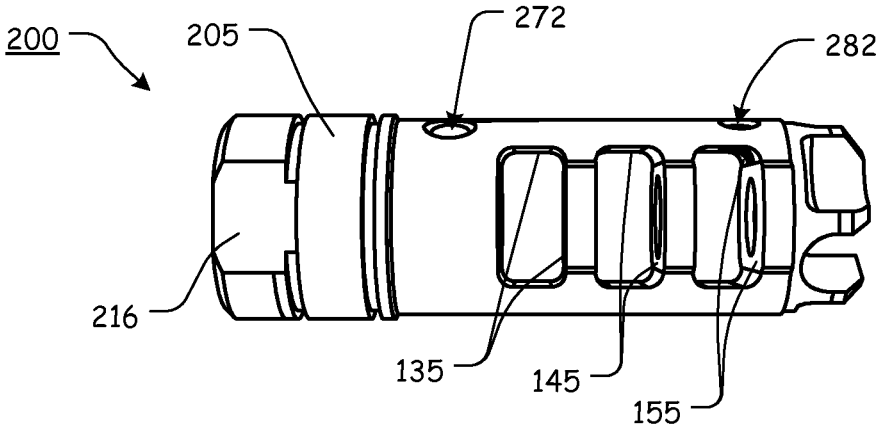
FIG. 24 shows a left side perspective view of a second exemplary embodiment of a muzzle device, according to this invention.
Figure 25:
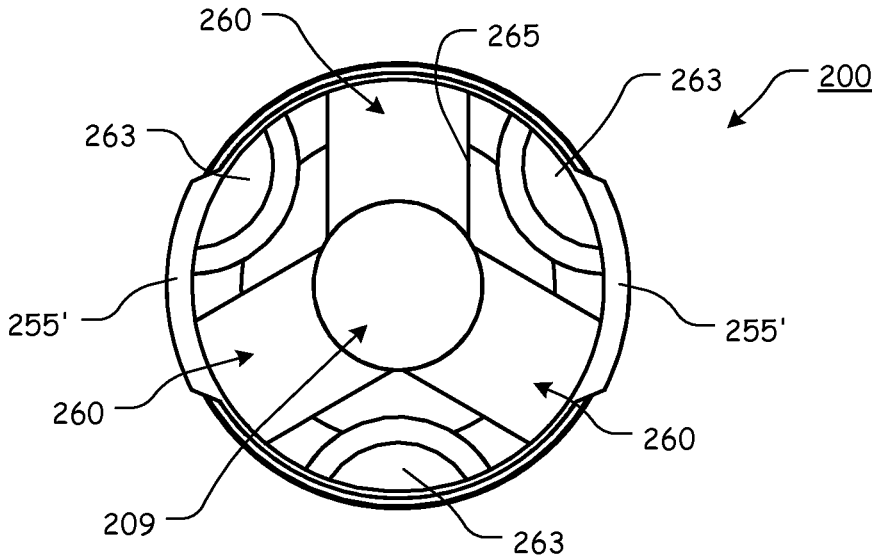
FIG. 25 shows a front view of a second exemplary embodiment of a muzzle device, according to this invention.
Figure 26:
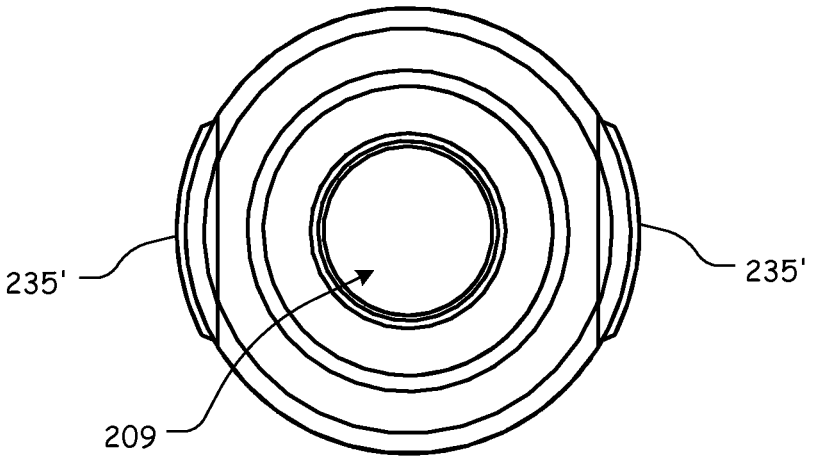
FIG. 26 shows a rear view of a second exemplary embodiment of a muzzle device, according to this invention.
Figure 27:
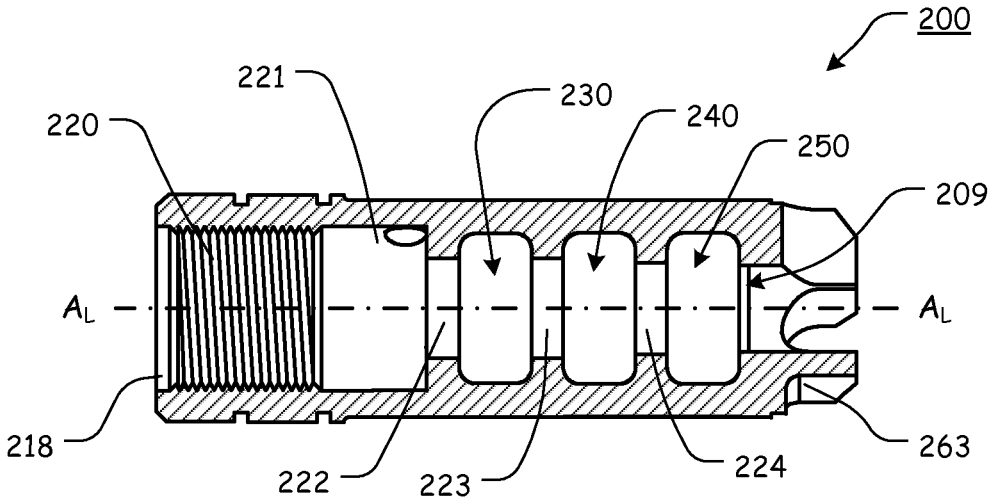
FIG. 27 shows a side cross-sectional view taken along line 27-27 of the gas block of FIG. 19, illustrating the first exemplary embodiment of the muzzle device according to this invention in greater detail.
Figure 28:
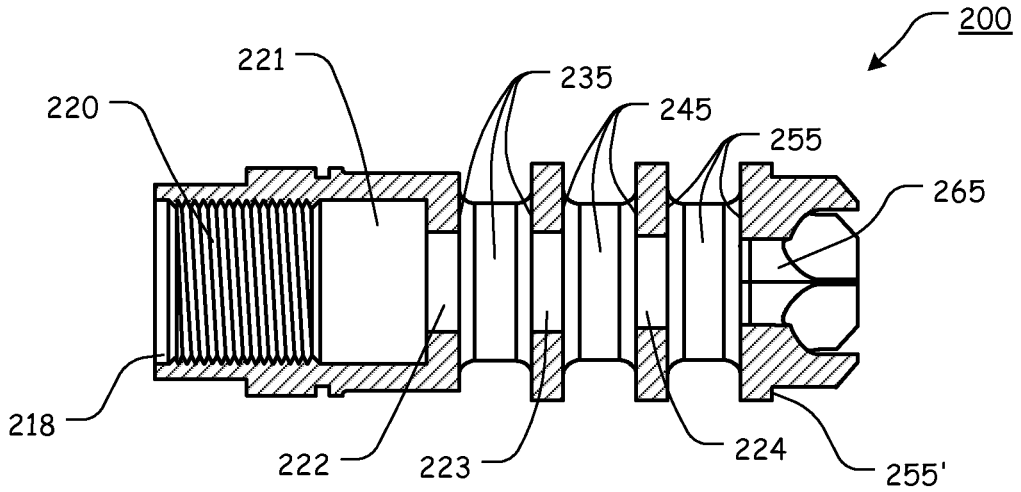
FIG. 28 shows a top cross-sectional view taken along line 28-28 of the gas block of FIG. 21, illustrating the first exemplary embodiment of the muzzle device according to this invention in greater detail.
Figure 29:
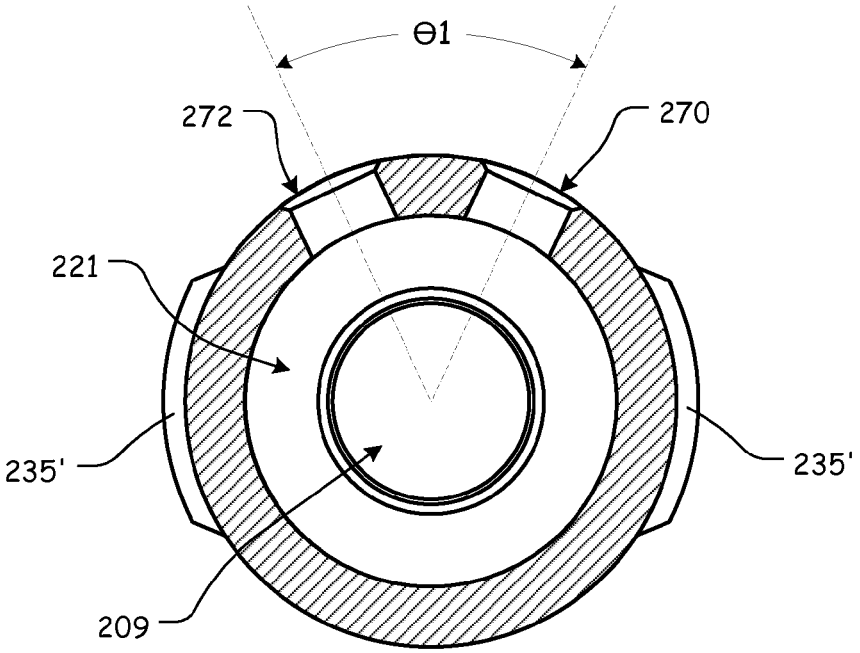
FIG. 29 shows a first rear cross-sectional view taken along line 29-29 of the gas block of FIG. 21, illustrating the first exemplary embodiment of the muzzle device according to this invention in greater detail.
Figure 30:
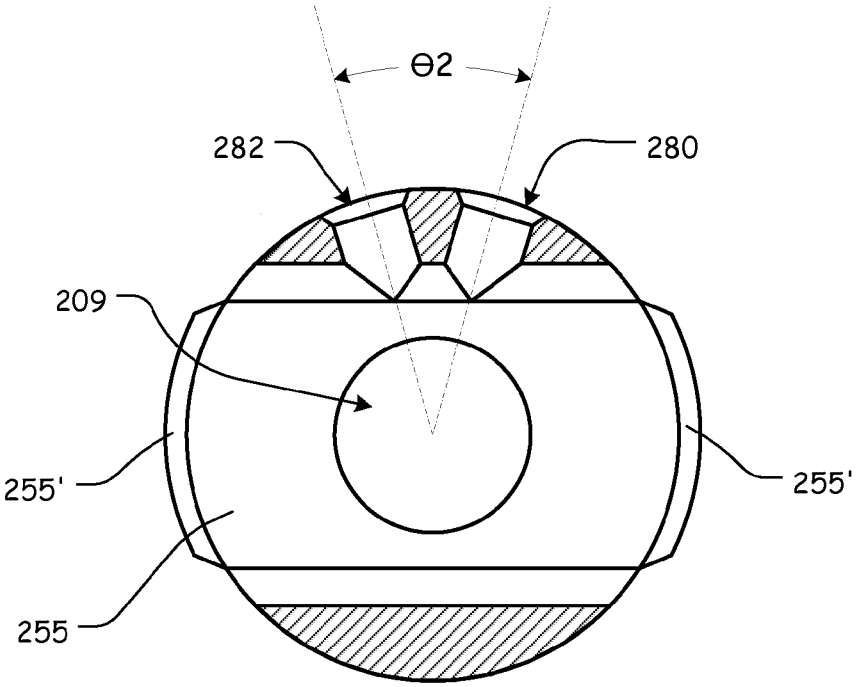
FIG. 30 shows a second rear cross-sectional view taken along line 30-30 of the gas block of FIG. 21, illustrating the first exemplary embodiment of the muzzle device according to this invention in greater detail.

In various exemplary embodiments, as illustrated most clearly in FIG. 14, the expansion apertures 180 and 182 are formed at an angle 2 to one another. In certain exemplary embodiments, the expansion apertures 180 and 182 are formed at an acute angle to one another, such that the expansion apertures 180 and 182 to form a "V". In this manner, the expansion apertures 180 and 182 divert a portion of the propellant gases in directions that reduce the tendency of the firearm to rise during recoil and direct the propellant gases and any debris expelled with the propellant gases away from the aligned sites of the firearm and out of the user's line of sight.

In various exemplary, nonlimiting embodiments, the muzzle brake 100 further comprises at least three flutes 160 extending from the terminal end 103, towards the initial end 102. In certain embodiments, the flutes 160 are defined by tapered sidewalls 165 extending outward from the central borehole aperture 109, towards the terminal end 103. The flutes 160 provide for a more complete burn of any propellant exiting the central borehole aperture 109 (and reduce any associated muzzle flash) and the breakup and misdirection of the remaining propellant gases that exit through the terminal end 103 of the muzzle brake 100.

In various exemplary, nonlimiting embodiments, the muzzle brake 100 further comprises a plurality of circular or radiused notches 163 extending from the terminal end 103 towards the initial end 102.

FIGS. 15-30 illustrate certain elements and/or aspects of a second exemplary embodiment of an enhanced muzzle brake 200, according to this invention. As illustrated in FIGS. 15-30, the enhanced muzzle brake 200 includes at least some of a body portion 205 extending from an initial end 202 to a terminal end 203, a central borehole aperture 209, a recessed portion 218, an internally threaded attachment portion 220, a first expansion chamber 221, a second expansion chamber 222, a third expansion chamber 223, a fourth expansion chamber 224, first baffle walls 235 defining a first baffle port 230, second baffle walls 245 defining a second baffle port 240, third baffle walls 255 defining a third baffle port 250, a pair of expansion apertures 270 and 272, a pair of baffle apertures 280 and 282, at least three flutes 260, a plurality of tapered sidewalls 265, a plurality of circular or radiused notches 263, and a flat 216.

It should be understood that each of these elements corresponds to and operates similarly to the body portion 105 extending from the initial end 102 to the terminal end 103, the central borehole aperture 109, the recessed portion 118, the internally threaded attachment portion 120, the first expansion chamber 121, the second expansion chamber 122, the third expansion chamber 123, the fourth expansion chamber 124, first baffle walls 135 defining the first baffle port 130, second baffle walls 145 defining the second baffle port 140, third baffle walls 155 defining the third baffle port 150, the pair of expansion apertures 170 and 172, the pair of baffle apertures 180 and 182, at least three flutes 160, the plurality of tapered sidewalls 165, the plurality of circular or radiused notches 163, and the flat 116, as described above with reference to the enhanced muzzle brake 100 of FIGS. 1-14.

However, as illustrated in FIGS. 15-30, the muzzle brake 200 includes extensions or fins 235', 245', and 255' that provide additional surface area to the first baffle wall 135, the second baffle wall 145, and the third baffle wall 155, respectively. As illustrated, the extensions or fins 235', 245', and 255' comprised portions of the respective baffle walls 135, 145, and 155, which extend beyond an outer diameter of the body portion 105.

By adding additional surface area, among other things, the ability of the muzzle brake 200 to dissipate heat is increased, which reduces the velocity of escaping propellant gasses. The additional surface area also reduces any increase in combustion, which would otherwise occur within the muzzle brake 200, thereby reducing potential muzzle flash and recoil.

It should also be appreciated that a more detailed explanation of the muzzle brake, instructions regarding the use and operation of the muzzle brake, and certain other items and/or techniques necessary for the implementation and/or operation of the muzzle brake are not provided herein because such background information will be known to one of ordinary skill in the art.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A muzzle brake, comprising:

a body portion extending along a longitudinal axis from an initial end to a terminal end;

a central borehole aperture extending through said body portion, along said longitudinal axis of said body portion, having a central borehole aperture diameter;

a first expansion chamber disposed within the central borehole aperture, proximate said initial end, wherein said first expansion chamber has a diameter greater than the central borehole aperture diameter;

first baffle walls defining a first baffle port, wherein said first baffle port comprises an aperture extending along a first baffle port longitudinal axis, wherein said first baffle port longitudinal axis is substantially perpendicular to the longitudinal axis of the central borehole aperture, and wherein said first baffle port is in fluid communication with said central borehole aperture and an exterior of the body portion such that at least some gasses from the central borehole aperture can be directed through the first baffle port to the exterior of the body portion;

second baffle walls defining a second baffle port, wherein said second baffle port comprises an aperture extending along a second baffle port longitudinal axis, wherein said second baffle port longitudinal axis is substantially perpendicular to the longitudinal axis of the central borehole aperture, and wherein said second baffle port is in fluid communication with said central borehole aperture and an exterior of the body portion such that at least some gasses from the central borehole aperture can be directed through the second baffle port to the exterior of the body portion;

third baffle walls defining a third baffle port, wherein said third baffle port comprises an aperture extending along a third baffle port longitudinal axis, wherein said third baffle port longitudinal axis is substantially perpendicular to the longitudinal axis of the central borehole aperture, and wherein said third baffle port is in fluid communication with said central borehole aperture and an exterior of the body portion such that at least some gasses from the central borehole aperture can be directed through the third baffle port to the exterior of the body portion;

a pair of expansion apertures, wherein each of said pair of expansion apertures is in fluid communication with said central borehole aperture in said first expansion chamber and an exterior of the body portion such that at least some gasses from the first expansion chamber can be directed through said pair of expansion apertures to the exterior of the body portion, and wherein said pair of expansion apertures are formed at an acute angle to one another; and a pair of baffle apertures, wherein each of said pair of baffle apertures is in fluid communication with said central borehole aperture within said third baffle port and an exterior of the body portion such that at least some gasses from the third baffle port can be directed through said pair of baffle apertures to the exterior of the body portion, and wherein said pair of baffle apertures are formed at an acute angle to one another.

2. The muzzle brake of claim 1, further comprising at least three flutes extending from said terminal end towards said initial end.

3. The muzzle brake of claim 1, further comprising a plurality of tapered sidewalls defining at least three flutes extending from said terminal end towards said initial end.

4. The muzzle brake of claim 1, further comprising a plurality of circular or radiused notches extending from said terminal end towards said initial end.

5. The muzzle brake of claim 1, wherein an outer diameter of said body portion is substantially consistent from said first expansion chamber to said terminal end.

6. The muzzle brake of claim 1, wherein said body portion comprises a first portion having a first outer diameter and a second portion having a second outer diameter, wherein said first portion is proximate said initial end and said second portion is proximate said terminal end, and wherein said first outer diameter is greater than said second outer diameter.

7. The muzzle brake of claim 6, wherein a transition portion is disposed between said first portion and said second portion.

8. The muzzle brake of claim 1, further comprising a second expansion chamber disposed between said first expansion chamber and said first baffle port, along said central borehole aperture, and wherein a diameter of said second expansion chamber is greater than the central borehole aperture diameter.

9. The muzzle brake of claim 8, further comprising a third expansion chamber disposed between said first baffle port and said second baffle port, along said central borehole aperture, and wherein a diameter of said third expansion chamber is equal to the diameter of the second expansion chamber.

10. The muzzle brake of claim 9, further comprising a fourth expansion chamber disposed between said second baffle port and said third baffle port, along said central borehole aperture, and wherein a diameter of said forth expansion chamber is less than the diameter of the second expansion chamber and greater than the central borehole aperture diameter.

11. The muzzle brake of claim 1, further comprising an internally threaded attachment portion extending along said central borehole aperture from said initial end to said first expansion chamber.

12. The muzzle brake of claim 11, further comprising a recessed portion of the internally threaded attachment portion extending along said central borehole aperture from said initial end to said internally threaded attachment portion.

13. The muzzle brake of claim 1 wherein at least a portion of said first baffle wall extends beyond an outer diameter of the body portion.

14. The muzzle brake of claim 1 wherein at least a portion of said second baffle wall extends beyond an outer diameter of the body portion.

15. The muzzle brake of claim 1 wherein at least a portion of said third baffle wall extends beyond an outer diameter of the body portion.

16. A muzzle brake, comprising:

a body portion extending along a longitudinal axis from an initial end to a terminal end;

a central borehole aperture extending through said body portion, along said longitudinal axis of said body portion, having a central borehole aperture diameter;

a first expansion chamber disposed within the central borehole aperture, proximate said initial end, wherein said first expansion chamber has a diameter greater than the central borehole aperture diameter;

first baffle walls defining a first baffle port, wherein said first baffle port is in fluid communication with said central borehole aperture and an exterior of the body portion such that at least some gasses from the central borehole aperture can be directed through the first baffle port to the exterior of the body portion, and wherein at least a portion of at least one of said first baffle walls extends beyond an outer diameter of the body portion;

second baffle walls defining a second baffle port, wherein said second baffle port is in fluid communication with said central borehole aperture and an exterior of the body portion such that at least some gasses from the central borehole aperture can be directed through the second baffle port to the exterior of the body portion, and wherein at least a portion of at least one of said second baffle walls extends beyond an outer diameter of the body portion;

third baffle walls defining a third baffle port, wherein said third baffle port is in fluid communication with said central borehole aperture and an exterior of the body portion such that at least some gasses from the central borehole aperture can be directed through the third baffle port to the exterior of the body portion, and wherein at least a portion of at least one of said third baffle walls extends beyond an outer diameter of the body portion;

a pair of expansion apertures, wherein each of said pair of expansion apertures is in fluid communication with said central borehole aperture in said first expansion chamber and an exterior of the body portion such that at least some gasses from the first expansion chamber can be directed through said pair of expansion apertures to the exterior of the body portion, and wherein said pair of expansion apertures are formed at an acute angle to one another; and a pair of baffle apertures, wherein each of said pair of baffle apertures is in fluid communication with said central borehole aperture within said third baffle port and an exterior of the body portion such that at least some gasses from the third baffle port can be directed through said pair of baffle apertures to the exterior of the body portion, and wherein said pair of baffle apertures are formed at an acute angle to one another.

17. The muzzle brake of claim 16, wherein a longitudinal axis of said first baffle port is substantially perpendicular to the longitudinal axis of the central borehole aperture, wherein a longitudinal axis of said second baffle port is substantially perpendicular to the longitudinal axis of the central borehole aperture, and wherein a longitudinal axis of said third baffle port is substantially perpendicular to the longitudinal axis of the central borehole aperture.

18. The muzzle brake of claim 16, further comprising a second expansion chamber disposed between said first expansion chamber and said first baffle port, along said central borehole aperture, and wherein a diameter of said second expansion chamber is greater than the central borehole aperture diameter.

19. The muzzle brake of claim 18, further comprising a third expansion chamber disposed between said first baffle port and said second baffle port, along said central borehole aperture, and wherein a diameter of said third expansion chamber is equal to the diameter of the second expansion chamber.

20. The muzzle brake of claim 19, further comprising a fourth expansion chamber disposed between said second baffle port and said third baffle port, along said central borehole aperture, and wherein a diameter of said forth expansion chamber is less than the diameter of the second expansion chamber and greater than the central borehole aperture diameter.

* * * * *